US006616078B1

(12) United States Patent
Gingras

(10) Patent No.: US 6,616,078 B1
(45) Date of Patent: Sep. 9, 2003

(54) REFINER PLATE WITH CHIP CONDITIONING INLET

(75) Inventor: Luc Gingras, Lake Oswego, OR (US)

(73) Assignee: Durametal Corporation, Tualatin, OR (US)

( * ) Notice: Subject to any disclaimer, the term of this patent is extended or adjusted under 35 U.S.C. 154(b) by 0 days.

(21) Appl. No.: 09/723,188

(22) Filed: Nov. 27, 2000

(51) Int. Cl.[7] ..... B02C 7/12

(52) U.S. Cl. ..... 241/261.2; 241/261.3; 241/298

(58) Field of Search ..... 241/261.2, 261.3, 241/298, 296

(56) References Cited

U.S. PATENT DOCUMENTS 3,125,306 A * 3/1964 Kollberg et al. ..... 241/298
4,166,584 A * 9/1979 Asplund ..... 241/261.3
4,676,440 A * 6/1987 Perkola ..... 241/261.3
5,971,307 A * 10/1999 Davenport ..... 241/259.1
6,325,308 B1 * 12/2001 Lofgren et al. ..... 241/261.3
6,402,071 B1 * 6/2002 Gingras ..... 241/261.2

* cited by examiner

*Primary Examiner*—John H. Husar
(74) *Attorney, Agent, or Firm*—Alix, Yale & Ristas, LLP

(57) ABSTRACT

A refiner plate segment for a refiner including opposed first and second refiner plates has radially inner and outer ends, multiple radially disposed bars, and grooves alternating with the bars. The base of at least one of the grooves has a variable base profile along the radial length of the base such that in at least one radial position between the inner and outer ends of the refiner plate segment, the base profile of the refiner plate segments of the first refiner plate has a low point and the base profile of the refiner plate segments of the second refiner plate has an oppositely disposed high point. The high point in the base profile forces lignocellulosic material carried on the second refiner plate onto the first refiner plate.

22 Claims, 8 Drawing Sheets

REFINER PLATE WITH CHIP CONDITIONING INLET

BACKGROUND OF THE INVENTION

The present invention relates generally to refiners for lignocellulosic material. More particularly, the present invention relates to refiner plate segments for such an apparatus.

In high consistency mechanical pulp refiners, the refining process has a principal goal of separating the lignocellulosic material into individual fibers and giving to these fibers certain mechanical and physical properties which will make them suitable for use in paper, board, building materials, and other products. The wood fibers are worked between two relatively rotating discs on which refiner plates are mounted. The plates usually include a primary refining zone having radial bars and grooves. Due to the large amount of energy transferred to the fiber in the primary refining process, a portion of the moisture content of the feed material is vaporized into steam. This steam separates into a "forward flowing" proportion, which will flow out with the refined fiber, and a "back flowing" proportion, which will flow back towards the refiner inlet.

The feed material is generally wood chips, wood particles, or wood debris from various sources. Generally, some degree of thermal softening of the wood fibers in the feed material is deemed necessary to allow the fibers to be in optimal condition for the primary refining operation. The back-flowing steam from the primary refining zone is generally the principal source of heat for the thermal softening of the feed material. It is therefore necessary to control the back flowing steam to ensure that a sufficient supply of steam is available to condition the feed material while preventing the back flowing steam from interfering with the stability of the feed.

Most conventional refiner plates fail to properly break down the feed material prior to the primary refining action. Generally, the thermal softening of the fibers in the feed material in these refiner plates is not consistent due to the non-uniform and relatively large size of the feed material particles and the limited period of time for conditioning. Those refiner plates which break down the feed material properly suffer from a lack of control of the feeding intensity, lack of proper feed distribution and/or an increased negative interaction between back-flowing steam and feed.

SUMMARY OF THE INVENTION

Briefly stated, the invention in a preferred form is a refiner plate segment for a refiner having opposed first and second refiner plates. Each refiner plate segment has radially inner and outer ends, multiple radially disposed bars, and grooves alternating with the bars. Each of the grooves defines a base having a radial length. The base of at least one of the grooves has a variable base profile along the radial length of the base such that in at least one radial position between the inner and outer ends of the refiner plate segment, the base profile of the refiner plate segments of the first refiner plate has a low point and the base profile of the refiner plate segments of the second refiner plate has an oppositely disposed high point. The high point in the base profile forces lignocellulosic material carried on the second refiner plate onto the first refiner plate.

For refiners having counter-rotating refiner plates, a single transfer of the material from one of the rotating refiner plates to the counter-rotating refiner plate, as described above, may suffice to provide all of the benefits of the subject invention. However, for "single disk" refiners (where there is only one rotating disk) transfer of the material back to the rotating disk is required to prevent stalling of the material on the stator disk. The refiner plate segments for such refiners therefore have three radially separated positions for transferring material between the stator and rotor plates. At a first radial position between the inner and outer ends, the base profile of the refiner plate segments of the first refiner plate has a low point and the base profile of the refiner plate segments of the second refiner plate has an oppositely disposed high point. At a second radial position between the outer ends and the first radial position, the base profile of the refiner plate segments of the first refiner plate has a high point and the base profile of the refiner plate segments of the second refiner plate has an oppositely disposed low point. At a third radial position between the outer ends and the second radial position, the base profile of the refiner plate segments of the first refiner plate has a low point and the base profile of the refiner plate segments of the second plate refiner has an oppositely disposed high point. Material is transferred from the second (stator) plate to first (rotor) plate at the first position, from the first plate to the second plate at the second position, and from the second plate to the first plate at the third position.

Using the base profile to control the interaction between the feed material and the stator and rotor plates allows the design of the bars to be customized to further improve the performance of the refiner plates. For example, the height of the bar of the refiner plate segments of the rotor plate may be made greater than the height of the bars of the refiner plate segments of the stator plate to increase the feeding effect of the rotor plate. The feeding effect of the rotor plate may also be increased by making the length of the bars of the refiner plate segments of the rotor plate may be made greater than the length of the bars of the refiner plate segments of the stator plate. The draft angle of the bars of the refiner plate segments of the stator plate may be made greater than the draft angle of the bars of the refiner plate segments of the rotor plate to increase the tangential frictional effect of the rotor bars.

It is an object of the invention to provide a refiner plate which partially separates and reduces the size of the feed material to a primary refiner plate.

It is also an object of the invention to provide a refiner plate which optimizes the feeding characteristics of the feed material to a primary refiner plate.

It is further an object of the invention to provide a refiner plate which evenly distributes feed material around a primary refiner plate.

It is still further an object of the invention to provide a refiner plate which promotes backflow of a quantity of steam appropriate for conditioning the feed material while minimizing the interaction between the steam and the feed material.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 3:
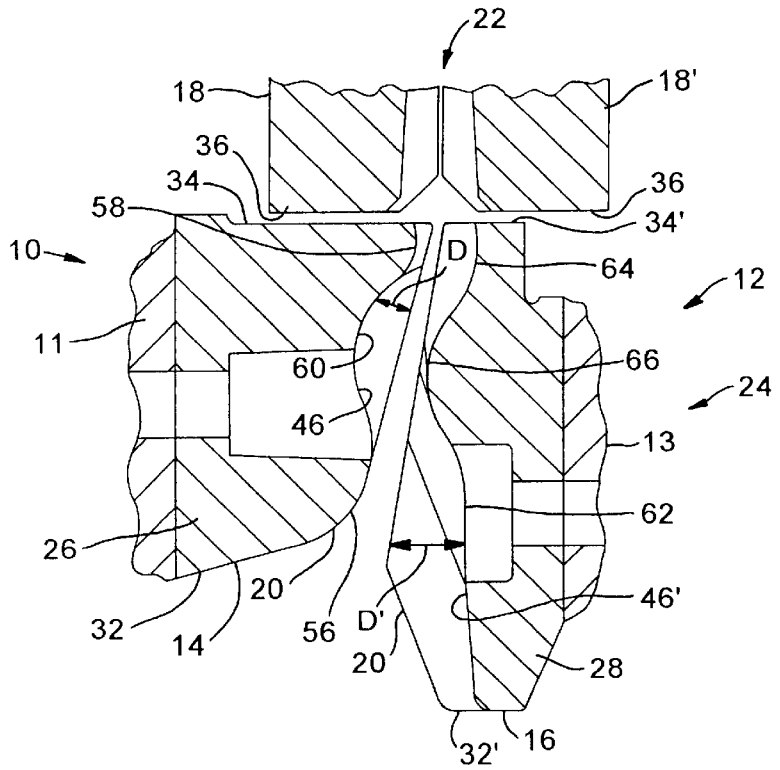
FIG. 3 is cross section view of the stator refiner plate segment taken along line 3*a*–3*a* of FIG. 1 and of the rotor refiner plate segment taken along line 3*b*–3*b* of FIG. 2.

With reference to the drawings wherein like numerals represent like parts throughout the several figures, a refiner in accordance with the present invention comprises a fixed stator plate 10 and a rotating rotor plate 12, each having an inner refining ring 14, 16 and an outer refining ring 18, 18' (FIG. 3). Each ring 14, 16, 18, 18' has a substantially annular refiner face 20 which forms a portion of a refiner region, when confronting the other refiner plate. The subject invention applies equally to double-disk refiners, where two refining elements rotate in opposite directions.

The outer rings 18, 18' of the stator and rotor plates 10, 12, which may be any conventional design, apply the main refining energy for fiber development and therefore define the primary refining zone 22. The inner rings 14, 16 of the stator and rotor plates 10, 12 reduce the size of the fibers, partially separate the fibers, distribute the fibers to the primary refining zone 22, and control the quantity of steam which back-flows from the primary refining zone and therefore define a preliminary refining zone 24. It should be appreciated that the inner and outer rings 14, 16, 18, 18' of the stator and/or the rotor may be combined into a single ring having a conventional primary refining zone 22 and a preliminary refining zone 24 in accordance with the invention. It should also be appreciated that the primary refining zone 22 may consist of more than one outer ring.

The inner rings 14, 16 of the stator and rotor plates 10, 12 are each composed of a plurality of refiner plate segments 26, 28, respectively, which are arranged side-by-side on the front face of a substantially circular refiner disc 11, 13. The plate segments 26, 28 are attached to the disc 11, 13 in any convenient or conventional manner, such as by bolts (not shown) passing through bores 30. One end of the bolt engages the disc 11, 13 and at the other end has head structure bearing against a countersunk surface. The remainder of this description will refer to a single plate segment 26, 28 but it should be understood that all the segments 26 which define the inner ring 14 the stator are preferably substantially similar and all of the plate segments 28 which define the inner ring 16 of the rotor are preferably substantially similar.

Figure 1:
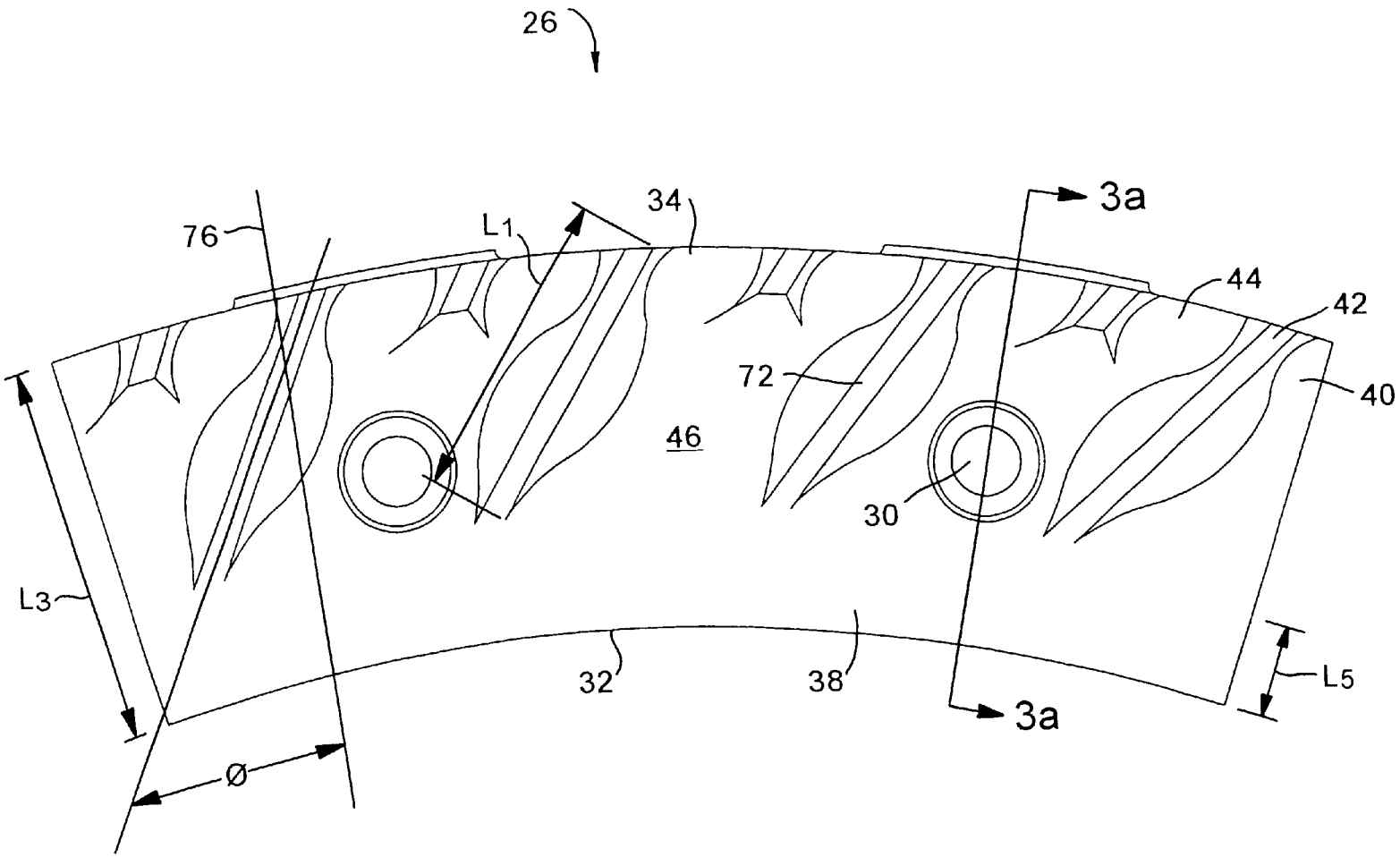
FIG. 1 is an elevation view of a first embodiment of a stator refiner plate segment in accordance with the invention.
Figure 2:
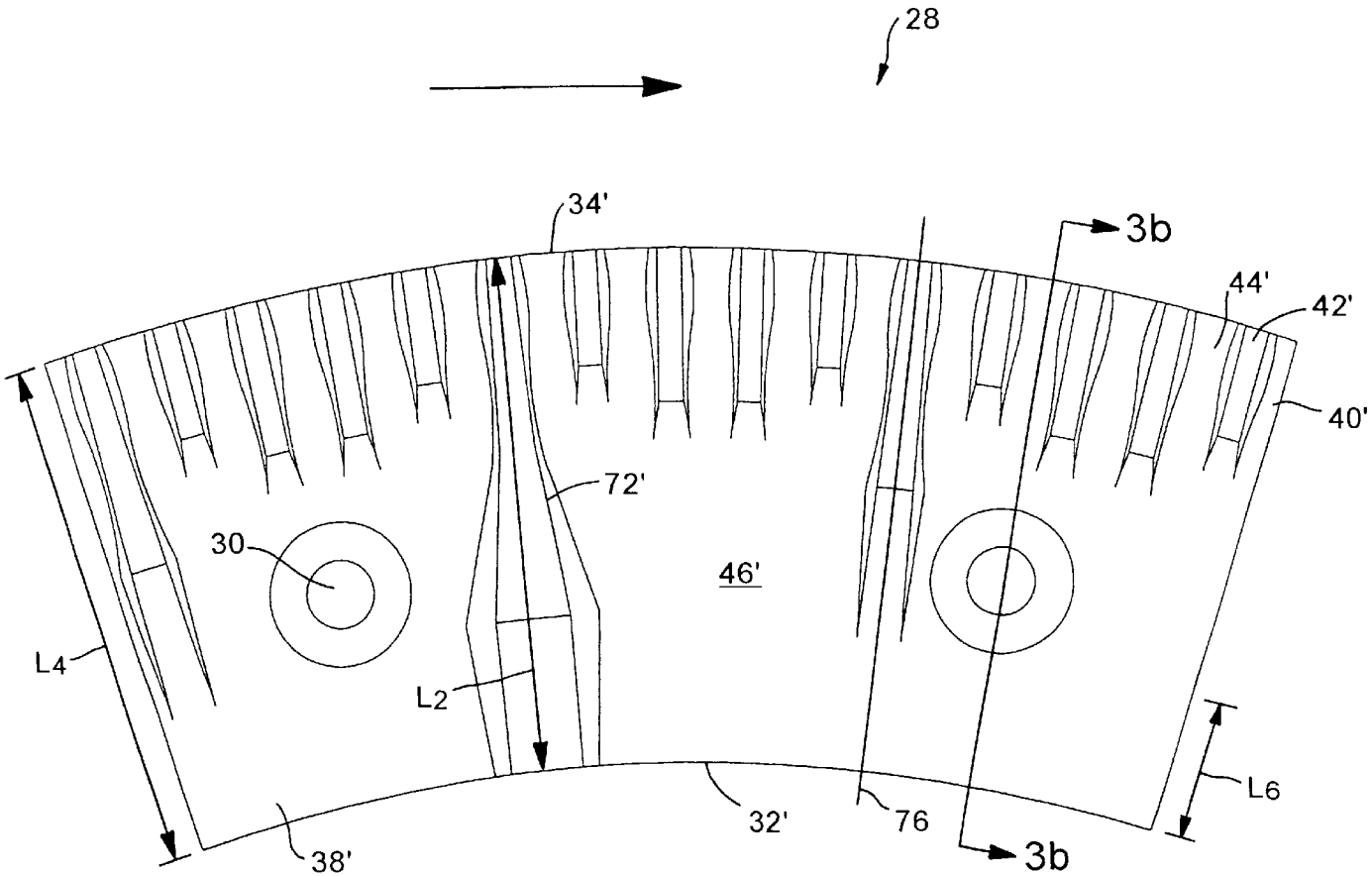
FIG. 2 is an elevation view of a first embodiment of a rotor refiner plate segment in accordance with the invention.
Figure 10:
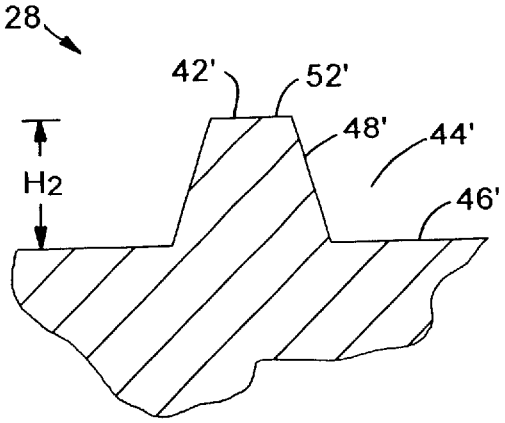
FIG. 10 is a cross section view taken along line X—X of FIG. 5, illustrating a bar having a shallow draft angle.
Figure 11:
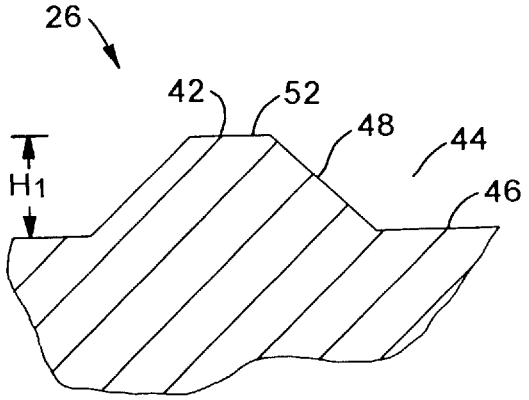
FIG. 11 is a cross section view taken along line XI—XI of FIG. 4, illustrating a bar having a large draft angle.

With reference to FIGS. 1 and 2, each refiner plate segment 26, 28 has an inner edge 32, 32' near the center of the plate 10, 12, an outer edge 34, 34' near the inner edge 36 of the outer ring 18, 18', and inlet and outlet portions 38, 38', 40, 40' adjacent the inner and outer edges 32, 32', 34, 34', respectively. Alternating bars 42, 42' and grooves 44, 44' extend substantially radially, i.e., radially, or parallel to a radius of the disc, or obliquely at an acute angle to such a radius, on the face of the plate segments 26, 28. The base 46, 46' from which the sides 48, 48' of the bars 42, 42' extend (FIGS. 10 and 11). The pattern of bars 42, 42' and grooves 44, 44' is especially adapted for receiving wood chips, wood pulp, or the like and performing an initial refining operation thereon to reduce the size of the material, partially separate the fibers, and direct the material radially outward into the primary refining zone 22. As the feed travels towards the outer periphery 34, 34' of the inner ring 14, 16 of plates 10 and 12, the refining gap 50 between the tops 52, 52' of opposing bars 42, 42' is reduced to ensure proper reduction of the size of the feed material.

To facilitate interaction between the feed material and the stator and refiner plates 10, 12, the plate segments 26, 28 have complementary base profiles 54, 54' along their radial length that are shaped to force material back and forth between the opposed inner rings 14, 16. Where the profile 54, 54' is defined as the distance D, D' between the base 46, 46' and the tops 52, 52' of the adjacent bars 42, 42' at any specific radial distance. The base profile 54, 54' is the same at any section around the disk. Therefore, the points where the material is forced across the refining gap 50 are uniformly and precisely located at a given radial position on the disk.

For example, in the first embodiment of the subject invention, the stator plate segment 26 has a base profile defining a first high point 56 (where distance D is relatively small) in the inlet portion 38, a second high point 58 in the outlet portion 40, and a low point 60 (where the distance D is relatively large) intermediate the first and second high point. The rotor plate segment 28 has a base profile defining a first low point 62 (where the distance D' is relatively large) in the inlet portion 38', a second low point 64 in the outlet portion 40', and a high point 66 (where the distance D' is relatively small) intermediate the first and second low points. As illustrated in FIG. 3, the first and second high points 56, 58 of the stator plate segment 26 are complementary to the first and second low points 62, 64 of the rotor plate segment 28 and the single high point 66 of the rotor plate segment 28 is complementary to the single low point 60 of the stator plate segment 26. Feed material traveling between these two refiner plates will be forced from the stator plate 10 to the rotor plate 12 due to the action of first high point 56 and first low point 62, from the rotor plate 12 to the stator plate 10 due to the action of high point 66 and low point 60, and finally from the stator plate 10 to the rotor plate 12 due to the action of second high point 58 and second low point 64.

The optimum number of forced transitions between the opposed disks is dependent on a number of factors, including the type of refiner, the type of feed material, and the degree of initial refining which is desired. A single round-trip journey back and forth may be sufficient to achieve the desired level of mechanical interaction between the feed material and the refining surfaces of the refiner plates. For example, on counter-rotating refiners, it may not be necessary to force the material back into the original feeding rotor disk as a single transfer from one rotor to the next rotor may suffice to promote all the benefits of the subject invention. In other cases it is preferable to increase the number of forced transitions between the opposed disks. For example, the transfer back to the original rotor disk is required on "single disk" refiners (where there is only one rotating disk) as the feed material would otherwise stall in the stator disk. The forced interaction also facilitates even distribution of the feed material around the rotor disk.

The base profile 54, 54' of the preliminary refining rings 14, 16 provides a relatively large volume, as compared to conventional refiner plates, for the steam to flow back from the primary refining zone 22 at all radial positions. This ensures that a sufficient quantity of steam flows back from the primary refining zone 22 to provide the heat which is required to soften the feed material. The base profile 54' of the stator plate segments 26 deflects the back-flowing steam onto the rotor plate segments 28, allowing the feeding effect of the rotor plate 12 to recover almost all of the particles of feed material carried by the steam. This will reduce the amount of fiber carried back to the heat recovery systems by the back-flowing steam, reducing plugging caused by such material and the mill down-time required to remove such plugging.

Using the base profile 54, 54' to control the interaction between the feed material and the stator and rotor plates 10, 12 provides flexibility in the design of the other plate segment components. Principally, the design of the bars of stator and rotor segments 26, 28 may be customized to improve the performance and operating characteristics of the refiner depending on the type of feed material and the specific refiner application. For example, a refiner typically experiences a loss of feed as the feed material travels on the stator plate 10, where there are no centrifugal forces to bias the feed material toward the periphery of the disk. The design of the bars 42, 42' of the stator and rotor plate segments 26, 28 may be modified such that the feeding effect of the rotor plate 12, which imparts centrifugal force on the feed material, becomes dominant to compensate for the loss of feed when the feed material travels on the stator plate 10. In double-disk refiners, where both disks rotate and impart a centrifugal force on the feed material, it may not be necessary to make the feeding effect of one of the disks dominant.

Figure 6:
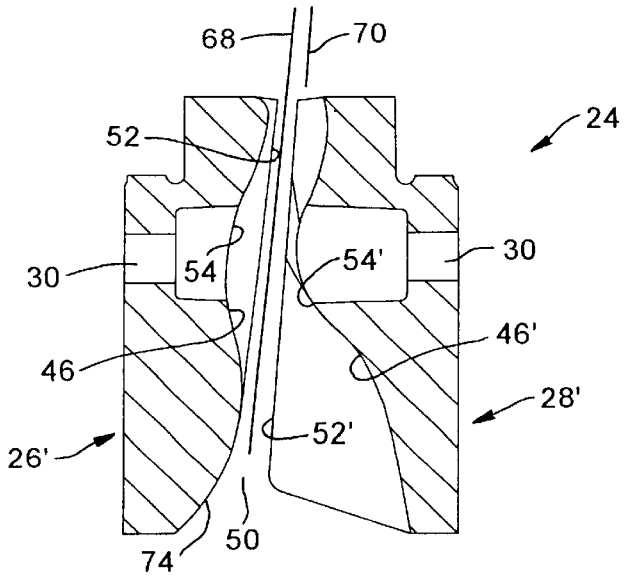
FIG. 6 is cross section view of the stator refiner plate segment taken along line 6*a*–6*a* of FIG. 4 and of the rotor refiner plate segment taken along line 6*b*–6*b* of FIG. 5.
Figure 4:
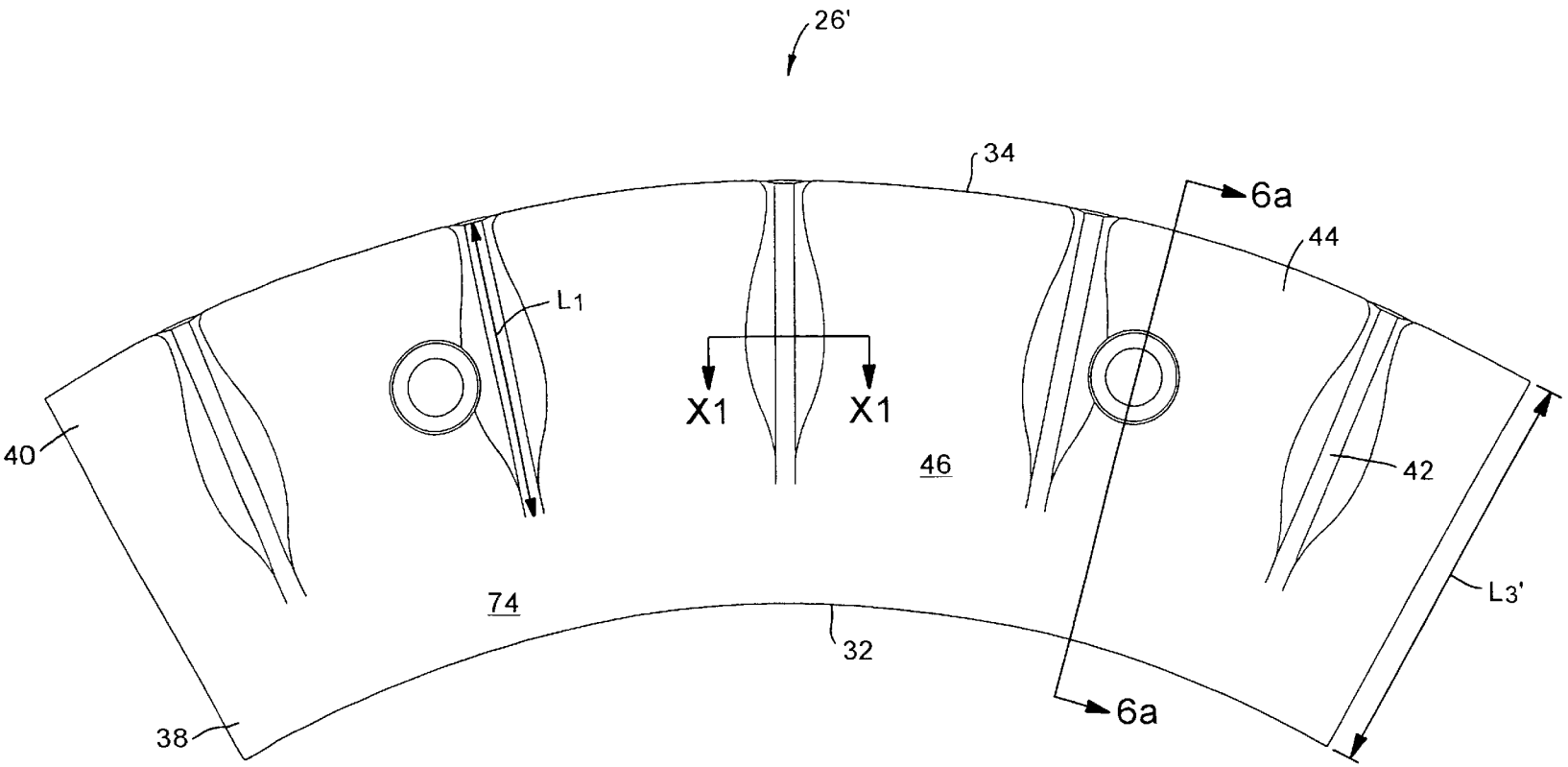
FIG. 4 is an elevation view of a second embodiment of a stator refiner plate segment in accordance with the invention.
Figure 5:
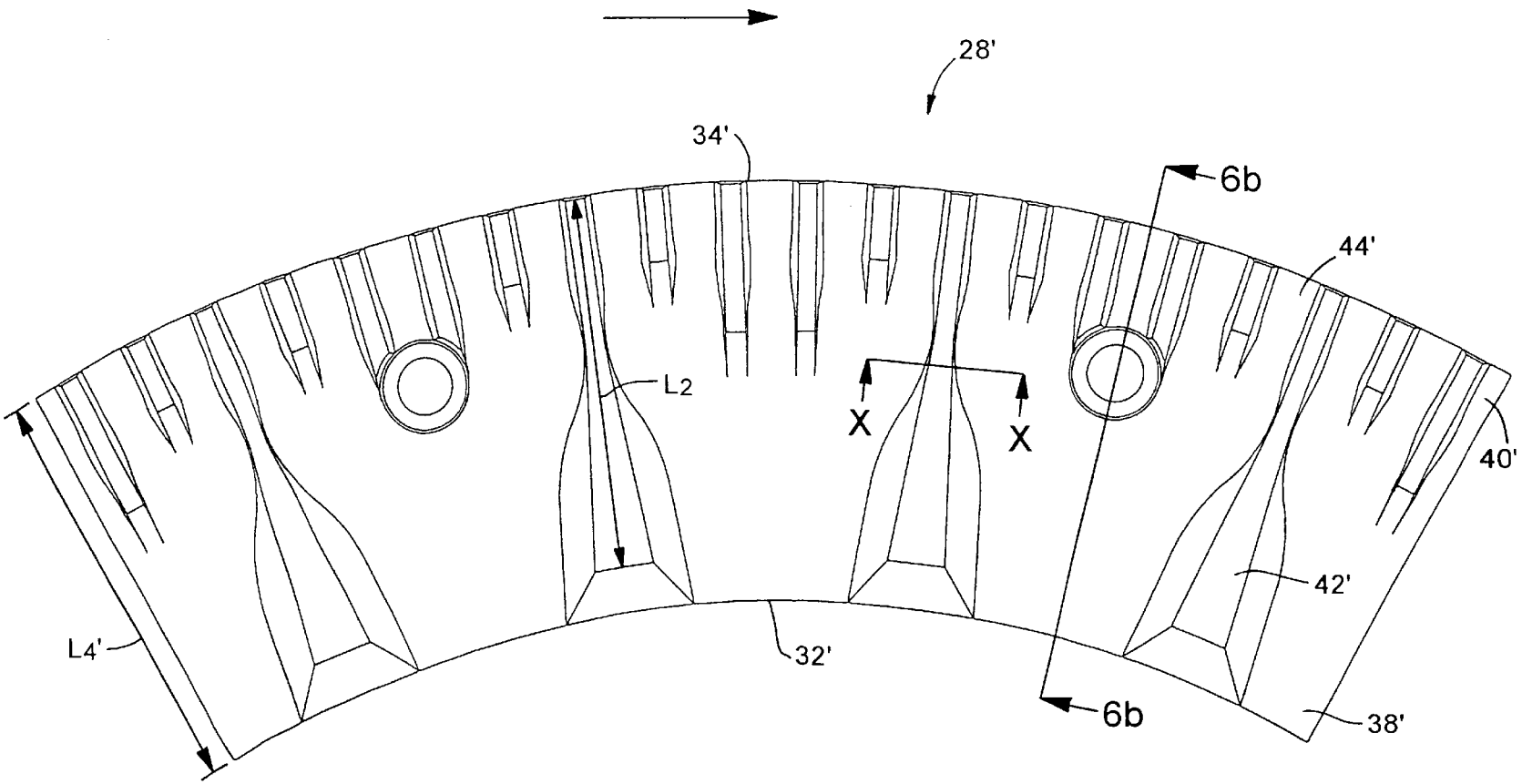
FIG. 5 is an elevation view of a second embodiment of a rotor refiner plate segment in accordance with the invention.
Figure 7:
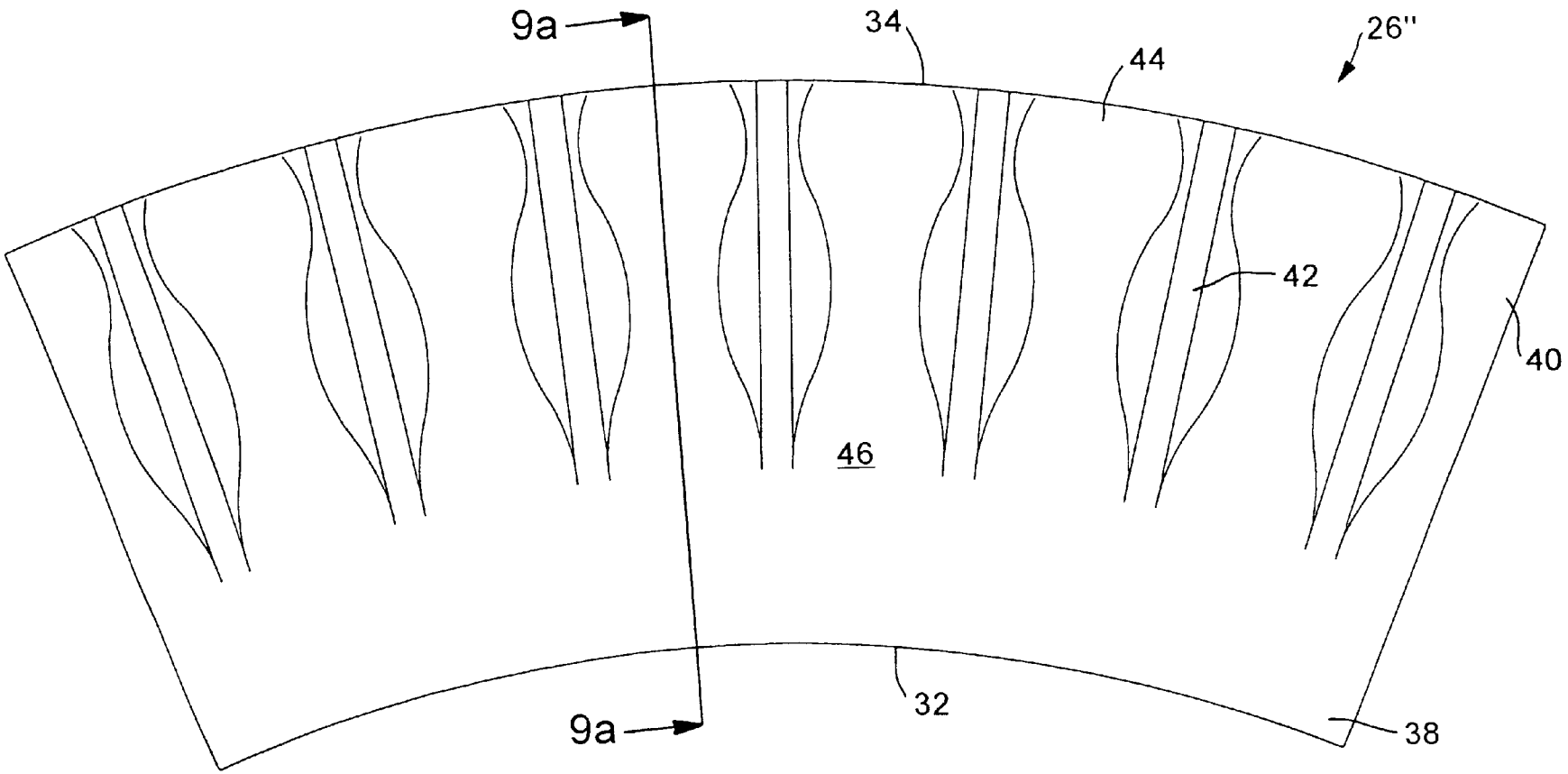
FIG. 7 is an elevation view of a third embodiment of a stator refiner plate segment in accordance with the invention.

In a first design, the rotor feeding effect is made dominant by increasing the height H2 of the bars 42' of the rotor plate segments 28 and reducing the height Hi of the bars 42 of the stator plate segments 26 as compared to conventional rotor and stator plate segments. This has the effect of shifting the centerline 68 of the refining gap 50, defined by the top surfaces 52, 52' of the bars 42, 42' of stator plate segments 26 and rotor plate segments 28, closer to the stator plate 10 and further from the rotor plate 12, as compared to the refining gap centerline 70 (FIG. 6) defined by the bars of conventional rotor and stator plate segments. Preferably, the height H2 of the rotor plate segment bars 42' is increased such that the bars 42' extend beyond the conventional centerline 70. The increased surface area of the leading side 72' of the rotor plate segment bars 42' and the decreased surface area of the leading side 72 of the stator plate segment bars 42 causes the feeding effect of the rotor plate 12 to dominate over the feeding effect of the stator plate 10.

In a second design, the rotor feeding effect is made dominant by reducing the length L1 of the stator plate segment bars 42, with the reduction in length taking place in the inlet portion 38 of the stator plate segment 26. The reduced surface area of the stator plate segment bars 42, compared to the surface area of the rotor plate segment bars 42' causes the feeding effect of the rotor plate 12 to dominate over the feeding effect of the stator plate 10. This second design is illustrated in FIGS. 1–6.

It should be appreciated that the subject application is intended to be applied to a broad range of refiner designs. For example, in the refiner design illustrated in FIGS. 4, 5 and 6, the distance between the inner and outer edges of the rotor and stator discs are substantially equal. This is reflected in the rotor and stator plate segments which are mounted to the rotor and stator plate discs. Consequently, the radial lengths L3', L4' of the stator and rotor plate segments 26', 28' of the second design are substantially equal with the inlet portion 38 of the stator plate segment 26' having a smooth surface 74 with no protruding bars. In the refiner design illustrated in FIGS. 1, 2 and 3, the distance between the inner and outer edges of the stator disc is shorter than that of the rotor disc. Again, this is reflected in the stator and rotor plate segments 26, 28 which are mounted to the discs. Here, the radial length L3 of the stator plate segment 26 is be shorter than the radial length L4 of the rotor plate segment 28, with the radial length L5 of the inlet portion 38 being substantially reduced as compared to the radial length L6 of the inlet portion 38' of the rotor plate segment 28.

In a third design, the feeding effect of either plate segment 26, 28 may be controlled by the angle $\Lambda$, $\phi$ of the bars 42, 42' relative to a radial line 76 passing through the disk (the feeding angle). Large feeding angles increase the feeding effect, while smaller angles, and even negative angles, reduce the feeding effect. For example, the bars 42' of the rotor plate segment 28" shown in FIG. 8 have a large, positive feeding angle $\theta$ and the bars 42 of the stator plate segment 26 shown in FIG. 1 have a large positive feeding angle $\phi$. The bars 42' of the rotor plate segment 28 shown in FIG. 2 however, have a neutral feeding angle, the angle of the bar 42' falling on the radial line 76 passing through the bar 42'.

The shape of the bars 42, 42' may also be modified to control the refining action of the various plate segments. Generally, the bars 42' on the rotor disk segments 23 have a shallow draft angle, as shown in FIG. 10, which allows the bars 42' to have a great tangential frictional effect during rotation. The profile of the bars 42 on the stator plate segments 26 generally have a large draft angle, as shown in FIG. 11, in order to minimize the tangential friction. When the feed material is projected into the stator ring 14, the impact on the bars 42 will case the material to fracture on impact. The impact will also re-direct the material back across the refining gap 50 onto the rotor plate 12 and thereby promote feeding into the outer primary refining ring 18, 18'.

Figure 8:
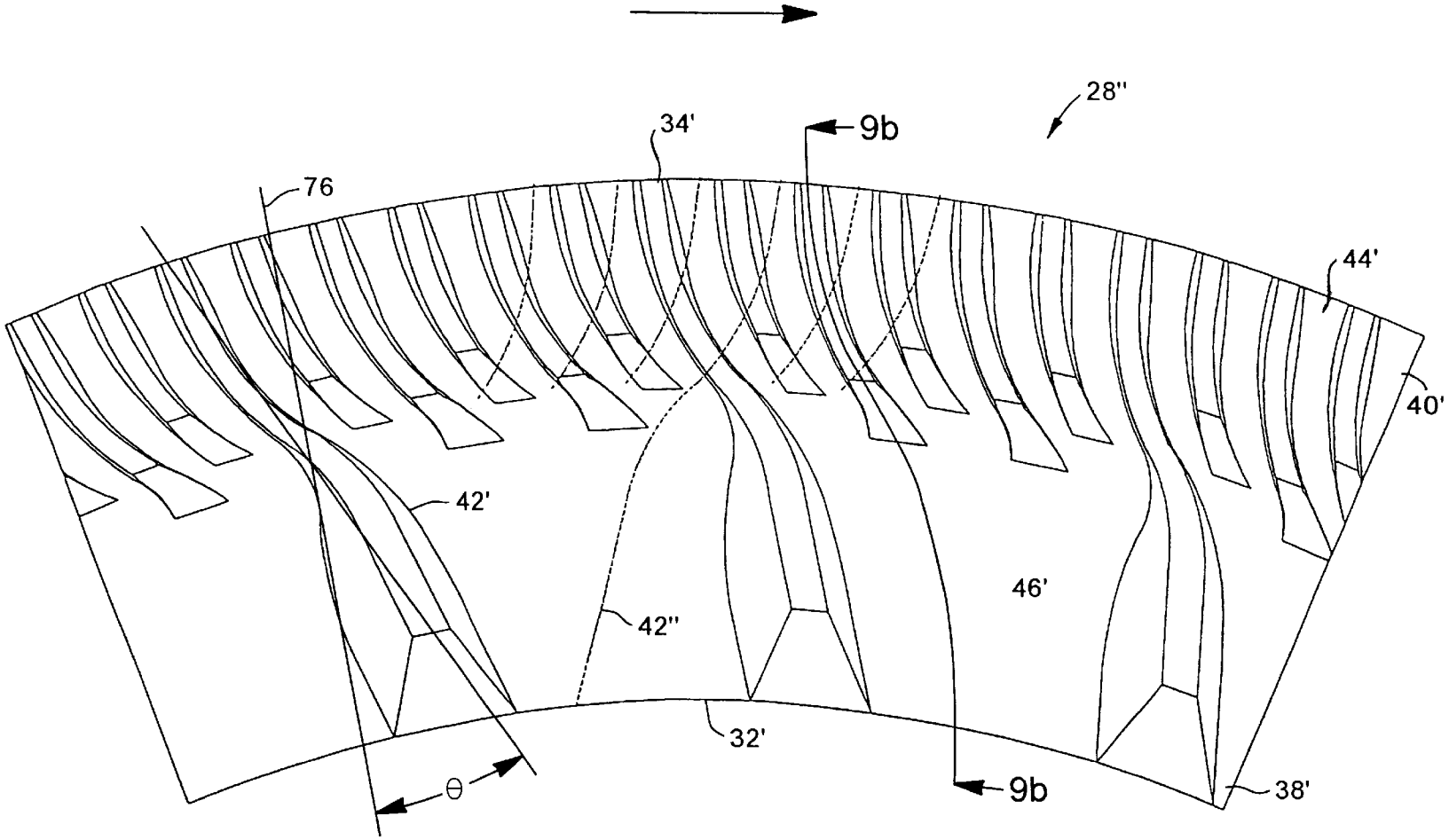
FIG. 8 is an elevation view of a third embodiment of a rotor refiner plate segment in accordance with the invention.
Figure 9:
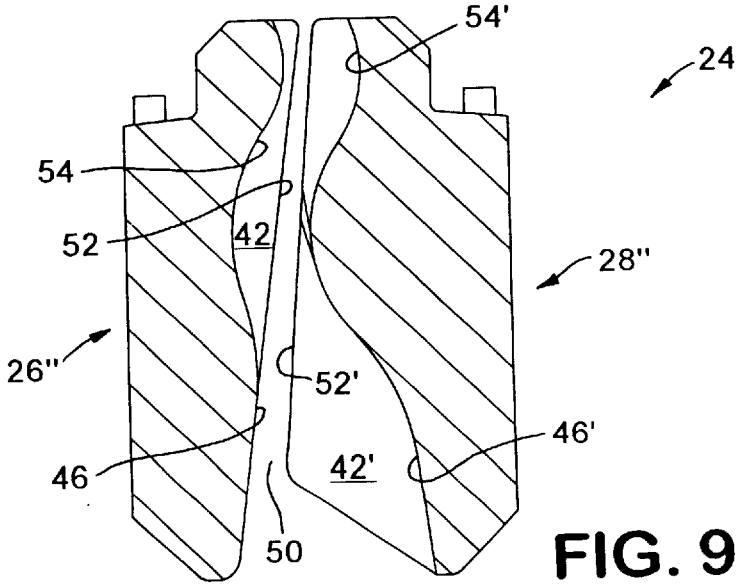
FIG. 9 is cross section view of the stator refiner plate segment taken along line 9*a*–9*a* of FIG. 7 and of the rotor refiner plate segment taken along line 9*b*–9*b* of FIG. 8.

It should be appreciated that for twin refiners, the bar and groove pattern of the second rotor disk will generally be the mirror image of the first rotor disk when the disks are viewed from the top. This is illustrated in FIG. 8 where dotted lines are used to compare the configuration of the bars 42' on the first rotor disk to that of the bars 42" on the second rotor disk. When the disk segments are installed, the bar and groove patterns on the opposed refining surfaces substantially align.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A refiner for refining lignocellulosic material including opposed first and second refiner plates, at least the first refiner plate rotating about an axis, each of the refiner plates having a plurality of refiner plate segments, each refiner plate segment defining a radially inner refining region comprising:

radially inner and outer ends;

a plurality of substantially radially disposed bars, each of the bars including a top surface; and a plurality of grooves alternating with the bars, each of the grooves defining a base having a radial length, the base of at least one of the grooves having a variable base profile along the radial length of the base;

wherein at a first radial position between the inner and outer ends the base profile of the refiner plate segments of the first refiner plate has a low point and the base profile of the refiner plate segments of the second refiner plate has a high point, whereby the base profile at the first radial position forces lignocellulosic material from the second refiner plate onto the first refiner plate.

2. The refiner of claim 1 wherein the first and second refiner plates each rotate about an axis, the first refiner plate rotating in a first direction and the second refiner plate rotating in a second direction which is opposite to the first direction.

3. The refiner of claim 1 wherein at a second radial position between the outer ends and the first radial position, the base profile of the refiner plate segments of the first refiner plate has a high point and the base profile of the refiner plate segments of the second refiner plate has a low point and at a third radial position between the outer ends and the second radial position, the base profile of the refiner plate segments of the first refiner plate has a low point and the base profile of the refiner plate segments of the second plate refiner has a high point, whereby the base profile at the second radial position forces material from the refiner plate segments of the first refiner plate onto the refiner plate segments of the second refiner plate and the base profile at the third radial position forces material from the refiner plate segments of the second refiner plate onto the refiner plate segments of the first refiner plate.

4. The refiner of claim 3 wherein the first refiner plate rotates about an axis and the second refiner plate is fixed.

5. The refiner of claim 1 wherein the top of the bars and the base of the grooves define a bar height, the bar height of the refiner plate segments of the first refiner plate being greater than the bar height of the refiner plate segments of the second refiner plate.

6. The refiner of claim 5 further comprising opposed first and second refiner discs, the first and second refiner plates being mounted to the first and second refiner discs, respectively, the top of the bars of the refiner plate segments of the first and second refiner plates defining a refining gap having a centerline disposed closer to the second refiner disc than to the first refiner disc.

7. The refiner of claim 5 wherein each of the bars further includes a leading face having a surface area, the surface area of the leading faces of the bars of the refiner plate segments of the first refiner plate being greater than the surface area of the leading faces of the bars of the refiner plate segments of the second refiner plate.

8. The refiner of claim 1 wherein the bars of the refiner plate segments of the first and second refiner plates each have a length, the length of the bars of the refiner plate segments of the first refiner plate being greater than the length of the bars of the refiner plate segments of the second refiner plate.

9. The refiner of claim 8 wherein the bars further include a surface area, the surface area of the bars of the refiner plate segments of the first refiner plate being greater than the surface area of the bars of the refiner plate segments of the second refiner plate.

10. The refiner of claim 1 wherein the bars and a radial line passing through the axis of the refiner plate define a feeding angle, the bars of the refiner plate segments of the first and second refiner plates having a large positive feeding angle.

11. The refiner of claim 1 wherein the bars and a radial line passing through the axis of the refiner plate define a feeding angle, the bars of the refiner plate segments of the first refiner plate having a neutral feeding angle.

12. The refiner of claim 1 wherein the bars further include leading and trailing surfaces defining a draft angle, the draft angle of the bars of the refiner plate segments of the second refiner plate being greater than the draft angle of the bars of the refiner plate segments of the first refiner plate.

13. A refiner for refining lignocellulosic material including opposed first and second refiner plates, at least the first refiner plate rotating about an axis, each of the refiner plates having a plurality of refiner plate segments, at least a first set of the refiner plate segments defining a radially inner refining region, each of the refiner plate segments in the first set comprising:

radially inner and outer ends;

a plurality of substantially radially disposed bars; and a plurality of grooves alternating with the bars, each of the grooves defining a base having a radial length, the base of at least one of the grooves having a variable base profile along the radial length of the base;

wherein at a first radial position the base profile of the refiner plate segments of the first refiner plate has a low point and the base profile of the refiner plate segments of the second refiner plate has an opposed high point, whereby the base profile at the first radial position forces lignocellulosic material from the second refiner plate onto the first refiner plate.

14. The refiner of claim 13 further including a second set of the refiner plate segments disposed adjacent the outer end of the first set of refiner plate segments, the second set of refiner plate segments defining a radially outer refining region.

15. The refiner of claim 13 wherein the first set of the refiner plate segments includes all of the refiner plate segments of each refiner plate, the first set of the refiner plate segments further defining a radially outer refining region disposed intermediate the inner refining region and the outer end.

16. A refiner plate segment for a refiner having opposed first and second refiner plates, each refiner plate segment comprising:

radially inner and outer ends;

a plurality of substantially radially disposed bars; and a plurality of grooves alternating with the bars, each of the grooves defining a base having a radial length, the base of at least one of the grooves having a variable base profile along the radial length of the base;

wherein in at least one radial position between the inner and outer ends of the refiner plate segments, the base profile of the refiner plate segments of the first refiner plate has a low point and the base profile of the refiner plate segments of the second refiner plate has an oppositely disposed high point.

17. The refiner plate segment of claim 16 wherein at a first radial position between the inner and outer ends the base profile of the refiner plate segments of the first refiner plate has a low point and the base profile of the refiner plate segments of the second refiner plate has an oppositely disposed high point, at a second radial position between the outer ends and the first radial position, the base profile of the refiner plate segments of the first refiner plate has a high point and the base profile of the refiner plate segments of the second refiner plate has an oppositely disposed low point, and at a third radial position between the outer ends and the second radial position, the base profile of the refiner plate segments of the first refiner plate has a low point and the base profile of the refiner plate segments of the second plate refiner has an oppositely disposed high point.

18. The refiner plate segment of claim 16 wherein each of the bars has a top, the top of the bars and the base of the grooves defining a bar height, the bar height of the refiner plate segments of the first refiner plate being greater than the bar height of the refiner plate segments of the second refiner plate.

19. The refiner plate segment of claim 16 wherein each of the bars has a leading face having a surface area, the surface area of the leading faces of the bars of the refiner plate segments of the first refiner plate being greater than the surface area of the leading faces of the bars of the refiner plate segments of the second refiner plate.

20. The refiner plate segment of claim 16 wherein each of the bars has a length, the length of the bars of the refiner plate segments of the first refiner plate being greater than the length of the bars of the refiner plate segments of the second refiner plate.

21. The refiner plate segment of claim 16 wherein each of the bars has a surface area, the surface area of the bars of the refiner plate segments of the first refiner plate being greater than the surface area of the bars of the refiner plate segments of the second refiner plate.

22. The refiner plate segment of claim 16 wherein each of the bars has leading and trailing surfaces defining a draft angle, the draft angle of the bars of the refiner plate segments of the second refiner plate being greater than the draft angle of the bars of the refiner plate segments of the first refiner plate.

* * * * *